US009732529B2

(12) United States Patent
Baum, Jr.

(10) Patent No.: US 9,732,529 B2
(45) **Date of Patent: *Aug. 15, 2017**

(54) SIMULATED LOG SIDING PANEL WITH HEW LINES

(71) Applicant: Ted Baum, Jr., Loveland, CO (US)

(72) Inventor: Ted Baum, Jr., Loveland, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/017,615

(22) Filed: Feb. 6, 2016

(65) Prior Publication Data

US 2016/0153197 A1 Jun. 2, 2016

Related U.S. Application Data

(62) Division of application No. 12/329,336, filed on Dec. 5, 2008, now Pat. No. 9,283,604.

(51) Int. Cl.

| | |
|---|---|
| ***E04F 13/12*** | (2006.01) |
| ***E04F 13/08*** | (2006.01) |
| ***B21D 5/08*** | (2006.01) |

(52) U.S. Cl.

CPC ..... *E04F 13/0871* (2013.01); *B21D 5/08* (2013.01); *E04F 13/123* (2013.01); *Y10T 29/49* (2015.01); *Y10T 29/5116* (2015.01)

(58) Field of Classification Search

CPC ..... E04C 2/08
USPC ..... 52/233, 313, 554
See application file for complete search history.

(56) References Cited

U.S. PATENT DOCUMENTS

| | | | | | |
|---|---|---|---|---|---|
| D46,456 | S | * | 9/1914 | Stough | D25/150 |
| 1,521,938 | A | * | 1/1925 | Gartenberg | E04F 13/0864 52/278 |
| 1,943,033 | A | * | 1/1934 | Midby | E04B 2/702 52/233 |
| 2,250,764 | A | * | 7/1941 | Hoess | E04F 13/0842 52/313 |
| 3,157,003 | A | * | 11/1964 | Domar | E04F 13/0864 52/531 |
| 3,312,031 | A | * | 4/1967 | Berg | E04D 3/30 52/316 |
| 3,849,960 | A | * | 11/1974 | Henry | E04B 2/32 52/233 |
| 3,953,946 | A | * | 5/1976 | Peters | E04D 1/06 52/313 |
| 3,977,141 | A | * | 8/1976 | Peters | B44F 9/02 52/313 |
| D291,249 | S | * | 8/1987 | Manning | D25/141 |
| 5,010,701 | A | * | 4/1991 | Halsey, Jr. | E04B 2/702 52/233 |
| 5,060,432 | A | * | 10/1991 | Christian | E04B 2/708 52/233 |

(Continued)

FOREIGN PATENT DOCUMENTS

| | | | | | |
|---|---|---|---|---|---|
| CA | 2330905 | A1 | * | 6/2002 | B21H 8/00 |

*Primary Examiner* — Robert Canfield
(74) *Attorney, Agent, or Firm* — John R. Ley

(57) ABSTRACT

An elongated metal simulated log siding panel has a curved portion that simulates the curvature of a natural construction log. A plurality of longitudinally extending and randomly transversely spaced permanent bends in the curved portion simulate hew lines of a natural construction log, thereby creating a more natural appearance. Rotating disks compress the metal into an elastomeric roller to create the hew line-simulating bends.

7 Claims, 11 Drawing Sheets

(56) References Cited

U.S. PATENT DOCUMENTS 5,181,358 A * 1/1993 Mead ..... E04B 2/708 52/233
5,423,153 A * 6/1995 Woolems ..... E04F 13/0864 52/233
5,586,422 A * 12/1996 Hoffner ..... E04F 13/18 52/233
5,694,728 A * 12/1997 Heath, Jr. ..... E04D 3/32 52/518
5,878,542 A * 3/1999 Cornelius ..... E04F 13/0864 52/233
6,065,260 A * 5/2000 Dickey ..... E04F 13/0864 52/529
6,272,802 B1 * 8/2001 Berberich ..... E04B 2/708 52/233
6,295,777 B1 * 10/2001 Hunter ..... E04F 13/0864 52/311.1
6,363,676 B1 * 4/2002 Martion, III ..... E04F 13/0864 52/519
6,367,220 B1 * 4/2002 Krause ..... E04F 13/0864 52/512
6,408,580 B1 * 6/2002 Jurvis ..... E04F 13/0864 52/233
6,418,680 B1 * 7/2002 Calkins ..... E04B 1/10 52/233
D462,790 S * 9/2002 Bullinger ..... D25/141
6,904,780 B2 * 6/2005 Bullinger ..... E04F 13/0864 72/130
7,412,803 B2 * 8/2008 Lehn ..... E04F 13/0864 52/233
D602,612 S * 10/2009 Baum, Jr. ..... D25/141
8,104,234 B1 * 1/2012 Sawyer ..... E04D 13/158 52/309.8
D663,047 S * 7/2012 Shaw ..... D25/139
8,545,968 B2 * 10/2013 Lynch ..... B27N 3/08 156/71
2001/0017020 A1 * 8/2001 Kern ..... E04F 13/0864 52/784.11
2001/0022056 A1 * 9/2001 Gifford ..... E04F 13/0736 52/311.1
2003/0029105 A1 * 2/2003 Jurvis ..... E04F 17/08 52/233
2003/0054189 A1 * 3/2003 Morgenstern ..... E04B 1/20 428/540
2005/0284051 A1 * 12/2005 Lehn ..... E04B 2/708 52/233
2006/0003144 A1 * 1/2006 Kaump ..... B32B 13/04 428/131
2007/0082180 A1 * 4/2007 King ..... B05D 5/061 428/174
2007/0193184 A1 * 8/2007 Mann ..... E04C 2/08 52/630
2007/0245667 A1 * 10/2007 Clegg ..... C04B 28/02 52/543
2008/0282629 A1 * 11/2008 Cook ..... B28B 7/007 52/233
2009/0301015 A1 * 12/2009 Simms ..... B44C 5/0415 52/313
2014/0342125 A1 * 11/2014 Rees ..... B24B 7/10 428/151

* cited by examiner

SIMULATED LOG SIDING PANEL WITH HEW LINES

CROSS REFERENCE TO RELATED APPLICATION

This is a division and continuation of U.S. application Ser. No. 12/329,336, filed Dec. 5, 2008 by the inventor hereof. The subject matter of prior U.S. application Ser. No. 12/329,336 is incorporated fully herein by this reference.

FIELD OF THE INVENTION

This invention relates to metal siding used on the exterior of residential and other buildings. More particularly, this invention relates to a new and improved metal simulated log siding panel having bends formed in the metal panel to simulate hew lines, thereby creating a more realistic appearance which simulates actual wooden construction logs. Further still, this invention relates to a new and improved method and apparatus for making metal simulated log siding panels having hew line-simulating bends.

BACKGROUND OF THE INVENTION

Both natural and artificial siding have been added to the exterior surfaces of buildings for many years, either as an original exterior for the building or on top of an existing exterior. One siding panel is attached to the exterior of the building, and another similarly-shaped panel is attached adjacent to the earlier panel. This process continues until the entire exterior of the building is covered by the attached siding panels. Adding siding panels on top of an existing exterior is an attractive and cost-effective alternative to repairing or replacing the existing exterior of the building. Changing the siding may also have the desirable effect of changing the exterior appearance and character of the building.

The typical forms of natural siding panels are flat wooden boards or strips of tree trunks which exhibit the exterior curvature of construction logs. The typical forms of artificial siding panels are metal or vinyl panels which have been formed into the shape of natural siding panels. Metal siding panels are usually made from aluminum or steel. Metal siding panels are painted and/or em bossed to more closely simulate the appearance of natural siding. Vinyl panels are usually painted or formed from colored synthetic plastic material. The advantage of artificial siding is that it is usually more maintenance-free than natural siding. Natural siding requires continual painting, conditioning and other types of care. In addition, artificial siding is usually less expensive than natural siding.

It is possible to form metal siding panels into a variety of geometric configurations which simulate natural siding panels. For example, metal panels have been formed into shiplap, board and batten, reverse board and batten, clapboard, colonial, vertical and horizontal double four, vertical and horizontal double five, and colonial Dutch configurations. A continuous siding forming machine is used to make these different metal siding panel configurations. A strip of flat sheet metal is moved through roller dies of the siding forming machine, and the roller dies sequentially shape and form the metal strip into the desired siding panel configuration.

Another configuration of metal siding is simulated log siding. Attaching simulated log siding panels to the exterior of a building converts the appearance of the building from a more conventional structure into the appearance of a log cabin or other log building. Use of simulated log siding has the potential of creating a noticeable change in the exterior appearance and character of a building. However, simulated log siding has only achieved moderate consumer acceptance, principally because the simulation of natural construction logs is not sufficiently realistic. A building having previous forms of simulated log siding is easily recognized as having artificial log siding.

The typical metal simulated log siding exhibits a uniform cylindrical shape which is intended to represent the convex curvature of a construction log. The uniform cylindrical shape is not an accurate or realistic simulation, because natural logs have various anomalies in shape, changes in curvature and other natural variations in appearance, all of which are unlike the smooth cylindrical shape of known previous metal simulated log siding panels. The uniformity and repetition of the smooth cylindrical shapes immediately reveals the artificial nature of previously known simulated log siding.

Attempts to counter the uniformity of smooth cylindrical simulated log siding have included embossing a wood grain-like texture on the exterior of the metal simulated log siding. However, the embossed wood grain-like texture cannot be observed from a distance, and has no effect on diminishing or moderating the continuous and repeated cylindrical monotony of known metal simulated log siding panels.

Other attempts to invoke a more realistic appearance in metal simulated log siding panels include coloring the space between the cylindrical convex portions to replicate the appearance of chinking. Chinking is used between natural construction logs to seal the spaces between the natural logs and shut out the exterior environment. The coloring which represents chinking may be directly adhered to the metal simulated log panel, or a separate chink-colored strip may be added once the metal simulated log siding panels have been installed on the building. While the attempt to replicate the appearance of chinking contributes a modest enhancement toward a more realistic appearance, the cylindrical similarity of the simulated log panels and the monotony of the repetitious identical cylindrical shapes creates the predominate overall appearance which is easily recognized as artificial.

SUMMARY OF THE INVENTION

The present invention significantly improves the level of realism of sheet metal simulated log siding, by creating the effect of hew lines on an exterior curved or intermediate portion of the panel. Hew lines on a natural construction log are longitudinal edges and lines that result from using a draw knife to cut away bark from a tree trunk that is finished into a construction log. Because the bark is removed manually with uneven movements of the draw knife, the hew lines on natural construction logs are somewhat random in position and in separation from one another.

The present invention creates permanent bends to replicate hew lines in the curved or intermediate portion of each metal simulated log siding panel. The hew line-simulating bends are random in position and separation along the length of the curved portion of the simulated log siding panel. The hew line-simulating bends also break up and disturb any perceived uniformity in appearance of the curved portion of the simulated log siding panel. When multiple simulated log siding panels of the present invention are attached to the exterior of a building, the random nature of the simulated hew lines and the lack of uniformity in the curved portions of the panels avoids the typical repetitious similarity of previously-known metal simulated log siding, thereby contributing a significant enhancement in the appearance and realism of metal simulated log siding panels. These considerations are involved in different aspects of the present invention.

One aspect of the invention involves a method of forming an elongated strip of metal into a simulated log siding panel which includes a curved portion that simulates curvature of a natural construction log. The method includes forming a plurality of longitudinally extending and transversely spaced permanent bends in the curved portion which simulate hew lines of a natural construction log.

Another aspect of the invention involves an elongated sheet metal simulated log siding panel. The simulated log siding panel comprises a curved portion that simulates the curvature of a natural construction log, and a plurality of longitudinally extending and transversely spaced permanent bends in the curved portion which simulate hew lines of a natural construction log.

Other or subsidiary aspects of the invention involve varying the transverse position of the hew line-simulating bends relative to margins of the curved portion along the length of the panel, varying the transverse position of the hew line-simulating bends relative to one another along the length of the panel, creating the curved portion of the simulated log siding panel by the hew line-simulating bends, forming offset wall portions on opposite margins of the curved portion to project the curved portion outward and provide visual relief for the curved portion, extending the hew line simulating bends substantially continuously along the length of the curved portion and the panel, and continuously forming the hew line-simulating bends in a continuous strip of sheet metal as the panel is formed, among other things.

A further aspect of the invention involves a log forming attachment for connection to a conventional seamless siding forming machine to create an elongated metal simulated log siding panel from a different panel configuration created by and delivered from the conventional siding forming machine. The log forming attachment comprises a plurality of circular disks located to contact one side of the panel configuration delivered from the siding forming machine, and a plurality of circular elastomeric rollers located to contact the other side of the panel configuration at a location opposite from the circular disks. Each circular disk is associated with an elastomeric roller. Each disk and associated elastomeric roller are positioned to receive between them the panel configuration delivered from the siding forming machine. Each disk and associated elastomeric roller have a relative separation between them which causes the panel configuration to be compressed into the elastomeric roller by the disk as the delivered panel configuration moves between the disks and associated elastomeric rollers. The compression of the panel configuration into the elastomeric roller induces a permanent bend in the panel configuration defined by the circular disk. Each induced permanent bend simulates a hew line in the simulated log siding panel.

Other or subsidiary aspects of the log forming attachment include a laterally deformed outer circular edge of each disk, deforming the outer circular edge of each of the disks in a different and random manner, using at least one circular disk which has a different diameter than at least one other circular disk, using one group of disks which have the same diameter and using another group of disks which have a different diameter, connecting at least one circular disk in a non-orthogonal relationship to a shaft about which the disk rotates, and inducing permanent hew line-simulating bends in the panel configuration which are sufficient to create curvature of the curved portion.

Other aspects of the invention, and a more complete appreciation of the present invention, as well as the manner in which the present invention achieves the above and other improvements, can be obtained by reference to the following detailed description of a presently preferred embodiment taken in connection with the accompanying drawings, which are briefly summarized below, and by reference to the appended claims.

DETAILED DESCRIPTION

Figure 1:
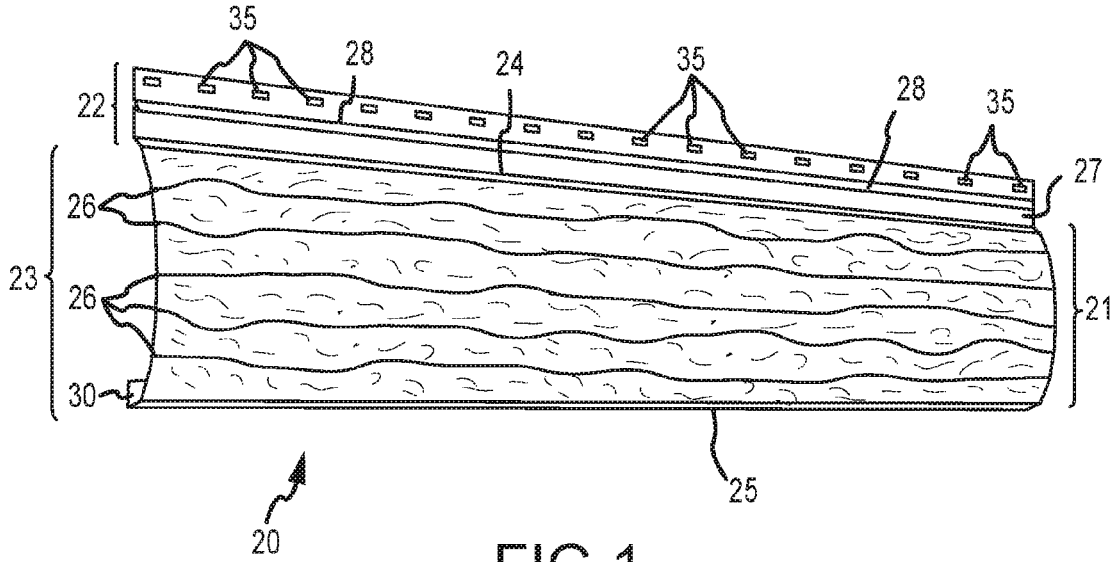
FIG. 1 is a perspective view of a metal simulated log siding panel which incorporates the present invention.
Figure 2:
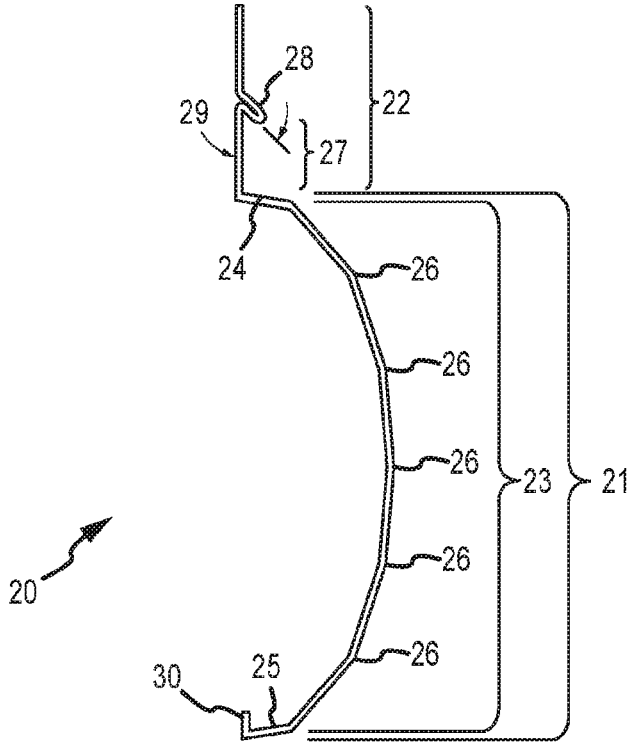
FIG. 2 is an end elevation view of the simulated log panel shown in FIG. 1.

A metal simulated log siding panel 20 which incorporates the present invention is shown in FIGS. 1 and 2. The simulated log panel 20 is formed from a sheet or strip of relatively thin gauge sheet metal, such as aluminum or steel, which has been bent into a convex shape 21 and into an attachment edge 22. The attachment edge 22 is used to connect the simulated log panel 20 to an exterior wall or surface of a building. The convex shape 21 is formed by an outer curved portion 23 and offset wall portions 24 and 25. The curved portion 23 replicates or simulates a natural log used in the construction of a building. The offset wall portions 24 and 25 project the curved portion 23 outward and provide relief to visually accentuate the curved portion 23, when the panel 20 is attached to the exterior of the building (FIG. 3).

Bends 26 are formed in the curved portion 23 to simulate hew lines that typically exist on natural construction logs. The hew line-simulating bends 26 are formed as permanent deformations in the curved portion 23. The hew line-simulating bends 26 also create the curvature of the curved portion 23 of the panel 20, while simultaneously preventing the curved portion 23 from assuming a uniform cylindrical shape. The hew line-simulating bends 26 extend continuously, or substantially continuously, along the entire length of the curved portion 23 of the simulated log panel 20. The hew line-simulating bends 26 are not straight, not uniformly spaced transversely from the margins of the curved portion 23, and not uniformly spaced transversely with respect to one another. Instead, each hew line-simulating bend 26 varies in transverse position on the curved portion 23 between the margins at those locations where the offset wall portions 24 and 25 intersect the curved portion 23. The hew line-simulating bends 26 also vary in transverse spacing relative to adjacent hew line-simulating bends 26.

The hew line-simulating bends 26 contribute substantially to the more authentic appearance of the simulated log siding panel 20. The unevenness and random-appearing nature of the hew line-simulating bends 26 replicate the random look of actual hew lines formed on natural construction logs which result from using a draw knife to strip natural bark from a tree trunk that becomes the construction log. The hew line-simulating bends 26 simulate the marks, edges or corners created by using the draw knife. The slight discontinuities or breaks in the curvature of the curved portion 23 created by the random hew line-simulating bends 26 also make the overall shape of the curved portion 23 comparable to the somewhat irregular shape of an actual construction log.

Figure 3:
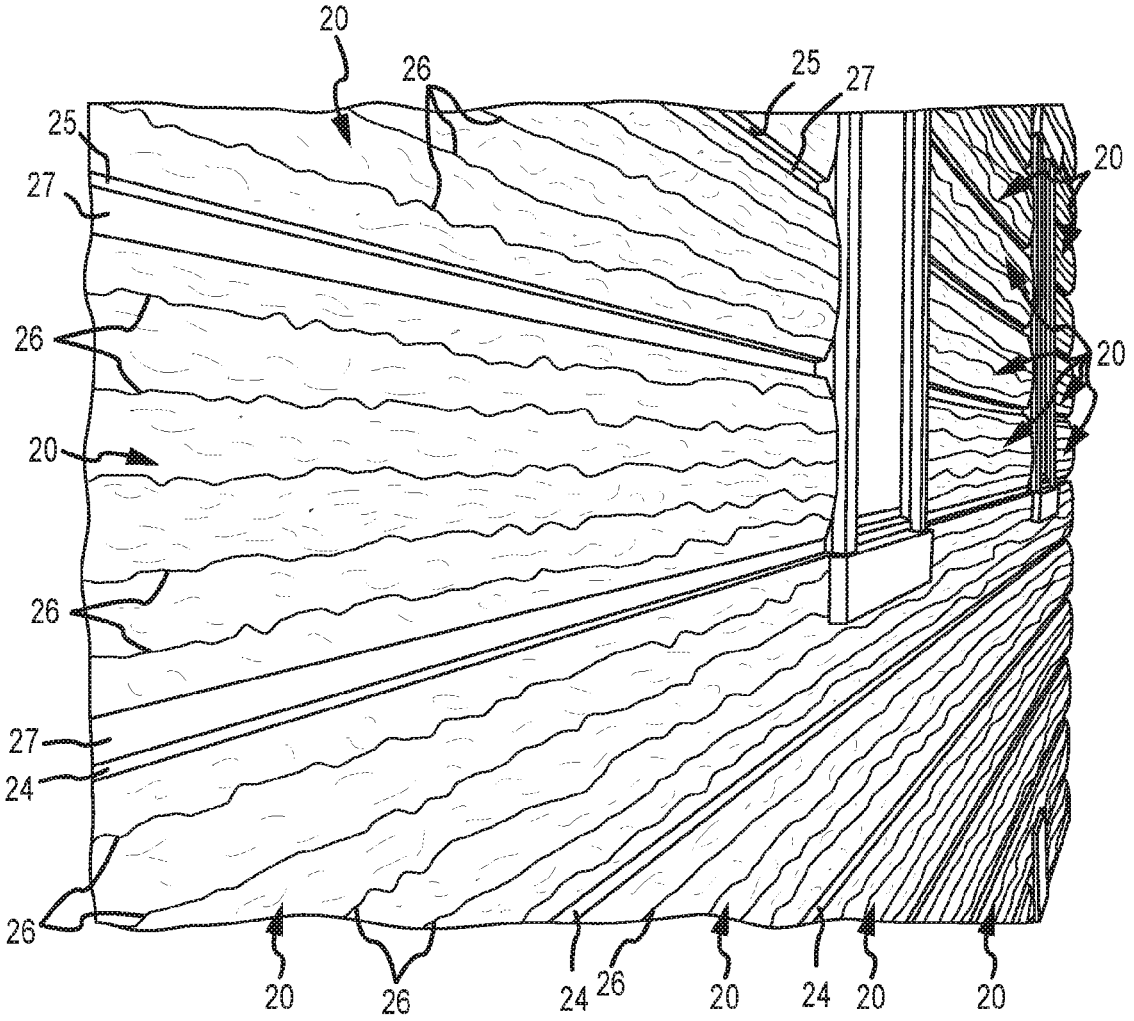
FIG. 3 is a perspective view of an exterior portion of a building to which there have been attached a plurality of the simulated log siding panels of the type shown in FIGS. 1 and 2.

The more authentic and realistic appearance of the simulated log siding panels 20 becomes more apparent when multiple panels 20 are attached to the exterior of the building, as shown in FIG. 3. As is apparent from FIG. 3, the continuous and random transverse position of the hew line-simulating bends 26 creates a strong overall resemblance to a natural construction log, particularly when multiple panels 20 cover the broad expanse of a building exterior.

The impression is also enhanced by the offset wall portions 24 and 25. Due to the forward projection of the curved portion 23 because of the offsetting wall portions 24 and 25, the curved portion 23 appears relieved on the exterior of the building, thereby contributing to the recognition of and focus on the curved portion 23 as simulating a construction log. Furthermore, the relief created by the offset wall portions 24 and 25 provides a space 27 (FIGS. 1 and 2) on the attachment edge 22 where a strip, coloring, or some other material may be located to replicate actual chinking between natural construction logs. Replicating chinking also contributes to the more authentic appearance.

The exemplary panels 20 shown have five hew line-simulating bends 26 extending along the length of the curved portion 23 of each panel 20, as best shown in FIG. 2. Five hew line-simulating bends 26 appear appropriate and consistent when the distance separating the margins between opposite edges of the curved portion 23 is approximately 8-10 inches. For panels 20 which replicate larger logs, represented by a greater distance between the margins of the curved portion 23, a greater number of hew line-simulating bends 26 is more appropriate. Conversely, a lesser number of hew line-simulating bends 26 should be used on panels 20 which replicate smaller-width construction logs. The number of hew line-simulating bends 26 should achieve an appealing, authentic and realistic appearance.

Each panel 20 also includes a flange retainer 28 which extends outward from a middle location on the attachment edge 22. The flange retainer 28 is separated from the offset wall portion 24 by the space 27, as shown in FIG. 2. The flange retainer 28 extends at an acute angle 29 (FIG. 4) from the attachment edge 22 and projects toward the convex shape 21. A lip 30 extends inward from a rear edge of the offset wall portion 25, on the opposite side of the convex shape 21 from the attachment edge 22. The lip 30 extends toward the attachment edge 22 and into an interior concave area behind the convex shape 21.

Figure 4:
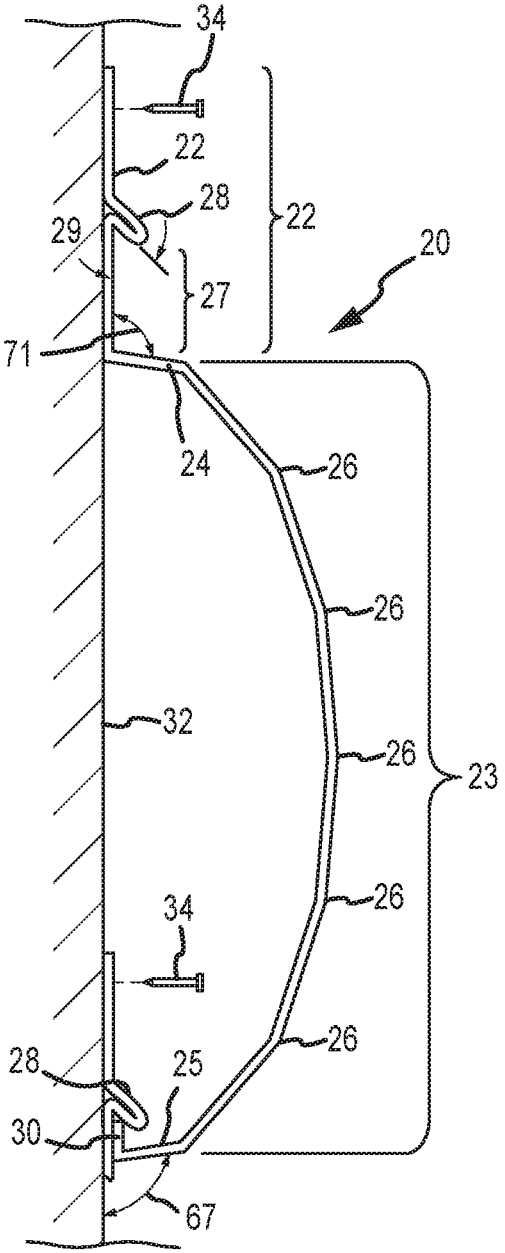
FIG. 4 is a view similar to FIG. 2, showing connection of the simulated log siding panel shown in FIG. 1 to the exterior surface of the building shown in FIG. 3.
Figure 5:
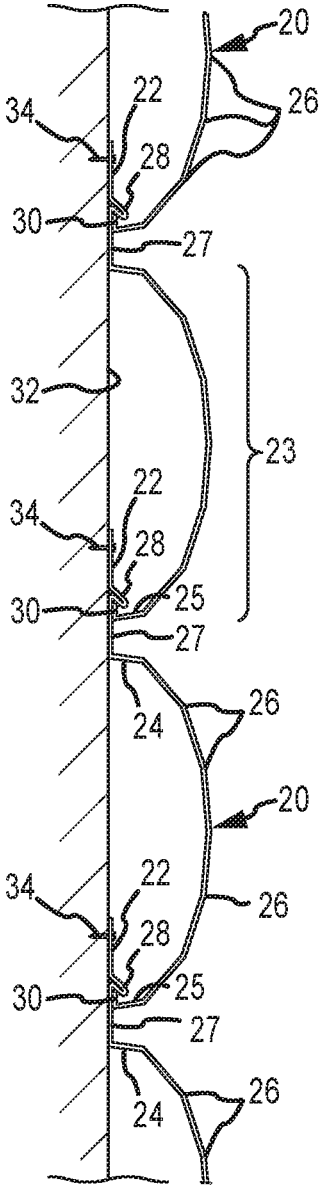
FIG. 5 is a view similar to FIG. 4, showing connection of a plurality of simulated log siding panels of the type shown in FIGS. 1, 2 and 4 to the exterior surface of the building shown in FIG. 3.

The retainer flange 28 and the lip 30 are used to connect the simulated log siding panels 20 to one another and to an exterior wall 32 of a building structure, as shown in FIGS. 4 and 5. The lip 30 of one panel 20 is inserted under a retainer flange 28 of a lower, immediately adjacent panel 20 which has been previously connected to the exterior wall 32. The upper attachment edge 22 of the panel 20 is thereafter attached to the exterior wall 32 with fasteners, such as screws or nails 34 which extend through attachment holes 35 (FIG. 1) formed in an outer marginal area of the attachment edge 22. The acute angle 29 of the retainer flange 28 of the lower adjacent panel 20 firmly retains the lip 30 of the upper adjacent panel 20 at the intersection of the retainer flange 28 and the attachment edge 22, without the need for separate fasteners. The next, immediately-adjacent panel 20 is connected in the same manner, until multiple levels or tiers of panels 20 have been attached and connected to each other in the same way to cover the exterior wall 32 of the building (FIG. 3).

To retain the lip 30 of the panel 20 at the lowermost level or tier on the exterior wall 32, a bottom attachment (not shown), which is similar to the attachment edge 22 with the flange retainer 28, is connected at the bottom of the exterior wall 32. Such a bottom attachment provides a flange retainer 28 to retain the lip 30 of the lowermost panel 20 connected to the exterior wall 32. As is apparent from FIGS. 4 and 5, the exposed area 27 of the attachment edge 22 presents an area upon which simulated chinking can be added.

When the simulated log panel is installed on the exterior wall, as shown in FIGS. 4 and 5, the dimension between the lip 30 and the flange retainer 28 of the lower log siding panel 20 and the position of the top attachment edge 22 of the upper log siding panel 20 is maintained at a constant dimension, so that the overall extent of curvature of the curved portion 23 of each of the log siding panels 20 is essentially the same when installed on the exterior wall of the building.

Each simulated log panel 20 is preferably seamless, meaning that it extends the entire length of the exterior wall 32 as shown in FIG. 3. A seamless panel 20 does not adjoin or connect to a horizontally adjacent similar panel 20. The seamless nature of each panel 20 also contributes to a realistic look, because natural log construction typically utilizes construction logs which extend the full length between typical breakpoints in the exterior walls, such as at corners, doors and windows. In the same way, seamless simulated log siding panels 20 extend between breakpoints in the exterior walls to further duplicate natural log construction techniques (FIG. 3).

Exemplary dimensions of the simulated log siding panel 20 which provide enhanced authenticity and appearance are as follows, all with reference to FIG. 4. The maximum point of curvature or separation of the curved portion 23 from the exterior wall 32 is about 1⅛ inches. The offset wall portions 24 and 25 are about 7/16 inches in width, meaning that the curved portion 23 is offset from the attachment edge 22 and the exterior wall 32 by slightly less than that same dimension. The area 27 between the adjacent offset wall portions 24 and 25 (FIG. 5) at which to attach simulated chinking is approximately ⅝ inches in width, once the two panels have been connected together (FIG. 5). These exemplary dimensions create enhanced visual effects for a panel 20 which has a width of its curved portion 23 between the marginal junctions with the flat offset wall portions 24 and 25 of approximately 8-10 inches.

The simulated log siding panel 20 is formed using a seamless siding metal forming machine 36, shown in FIGS. 6-9. The seamless siding forming machine 36 is conventional except for certain modifications described below. A log forming attachment 40, shown in FIGS. 18-23, is attached to a rear end of the siding forming machine 36. The log forming attachment 40 and the below-described modifications to the siding forming machine 36 transform a partial seamless siding panel configuration 72 (FIG. 13) into the simulated log siding panel 20 (FIG. 2).

The seamless siding forming machine 36 operates on a continuous strip 44 of metal which is unwound from a coil or spool 46. A motor 48 is connected to move a chain 50 and thereby rotate sprockets 52 to which the chain 50 is connected. The sprockets 52 are connected to shafts 53, and rollers 54 are connected to the shafts 53 along the length of the machine 36. The rollers 54 pull the metal strip 44 through the machine 36. Roller dies 56, 59, 60, 62, 63, 68, 69 and 70 (FIGS. 6-9 and 15) are located at a series of metal forming stations located along the length of the machine 36. The roller dies interact with the moving metal strip 44 to form the bends and configurations shown in FIGS. 10-14 as the metal strip 44 progresses through the machine 36.

Figure 7:
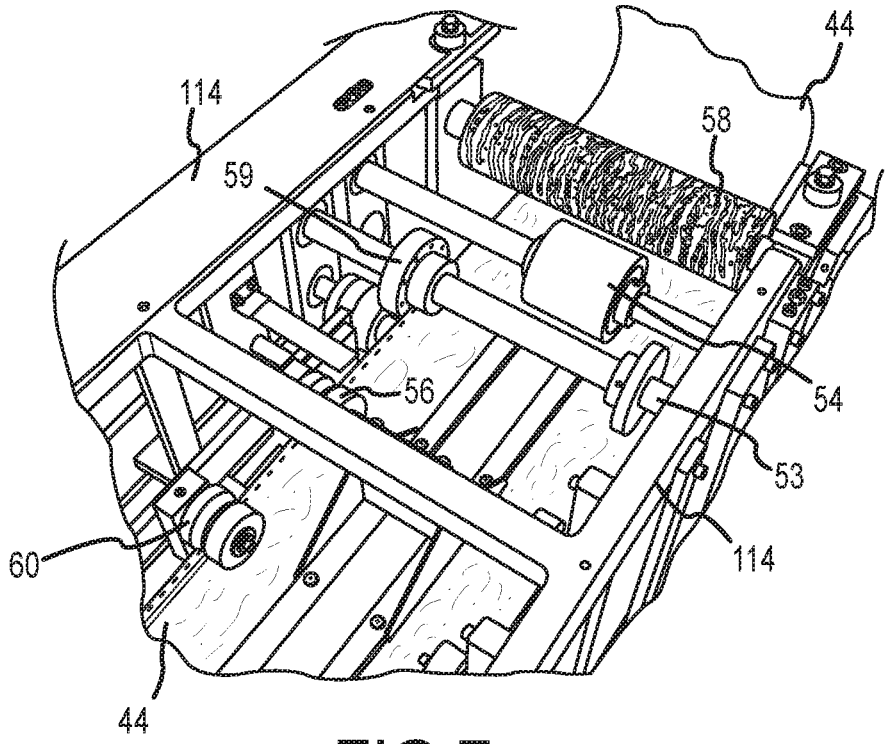
FIG.7 PRIOR ART
FIG. 7 is a partial perspective view of a front portion of the prior art seamless siding forming machine shown in FIG. 6, illustrating components including a wood grain embossing roller.
Figure 8:
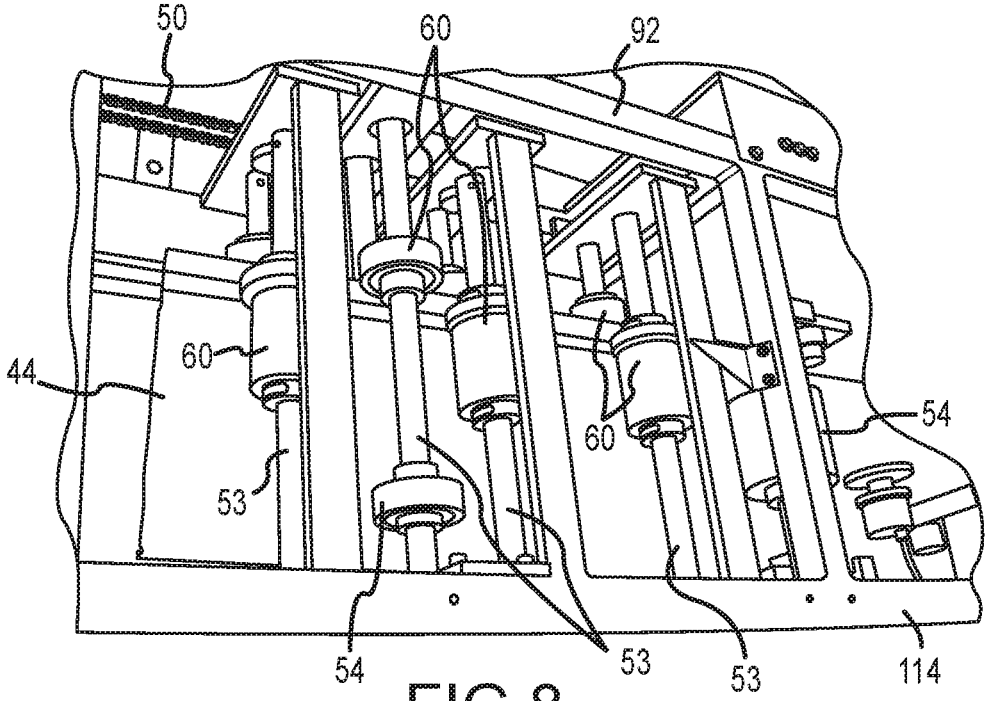
FIG.8 PRIOR ART
FIG. 8 is partial perspective view of a middle portion of the prior art seamless siding forming machine shown in FIGS. 6 and 7, illustrating a plurality of metal forming roller dies.

A first metal forming station of the seamless siding forming machine 36, shown in FIG. 7, is a conventional embossing roller 58. The embossing roller 58 creates a surface pattern or texture in the metal strip 44 which simulates the grain or texture characteristics of natural wood. The simulated grain and texture characteristics are permanently formed in the metal strip 44 and the finished simulated log siding panel 20.

Figure 10:
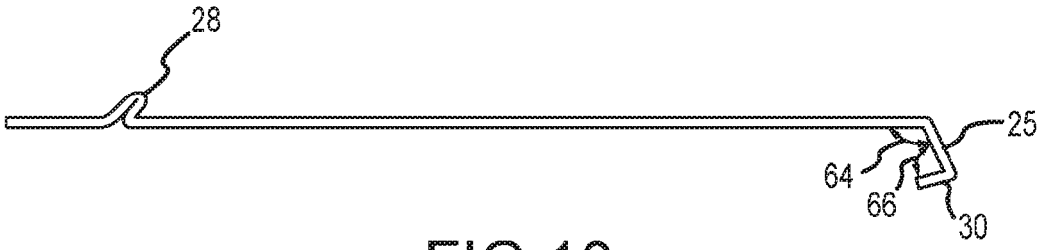
FIGS. 10-14 are end elevation views showing configurations of bent sheet metal existing at different metal forming stations of the siding forming machine shown in FIGS. 6-9.
Figure 16:
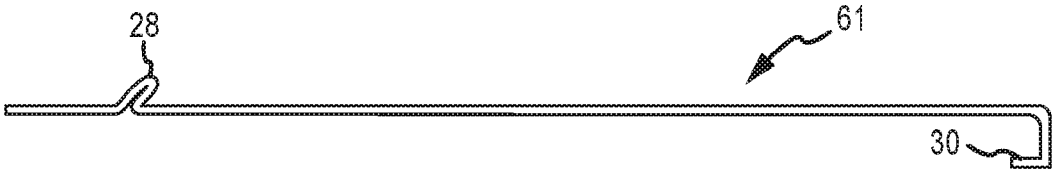
FIG.16 PRIOR ART
FIG. 16 is an end view of a prior art shiplap siding panel.

The next metal forming station of the machine 36 includes a conventional hole-punching die 59 which produces the attachment or nail holes 35 (FIG. 1) in the attachment edge 22 of the panel 20. Conventional roller dies 60, shown in FIGS. 7 and 8, next bend the flange retainer 28 (FIG. 2) along one transverse edge of the metal strip 24 which will become the attachment edge 22, as shown in FIG. 10. Other conventional roller dies (not shown) produce the bends which form the offset wall portion 25 and the lip 30 on the opposite transverse edge of the metal strip 44. A conventional seamless siding forming machine which has not been modified in accordance with the present invention could convert the configuration shown in FIG. 10 into a conventional shiplap siding panel 61 shown in FIG. 16, by employing a subsequent metal forming station (not shown) to bend the offset wall portion 25 perpendicularly with respect to the center of the metal strip 44 and to bend the lip 30 perpendicularly with respect to the offset wall portion 25.

The metal forming roller dies bend the offset wall portion 25 until it extends at an obtuse angle 64 relative to the center of the metal strip 44, as shown in FIG. 10. The lip 30 is bent to extend at an acute angle 66 relative to the offset wall portion 25. Bending the lip 30 at the acute angle 66 facilitates connecting the lip 30 to the flange retainer 28 (FIGS. 4 and 5), to hold the simulated log siding panel 20 in a firmly retained position on the exterior wall 32. The acute angle 66 also extends the offset wall portion 25 at an obtuse angle 67 (FIG. 4) relative to the exterior surface 32 of the building when the panel 20 as it attached to an adjacent panel 20. The angle 66 (FIG. 10) is the complement of angle 67 (FIG. 4).

Figure 9:
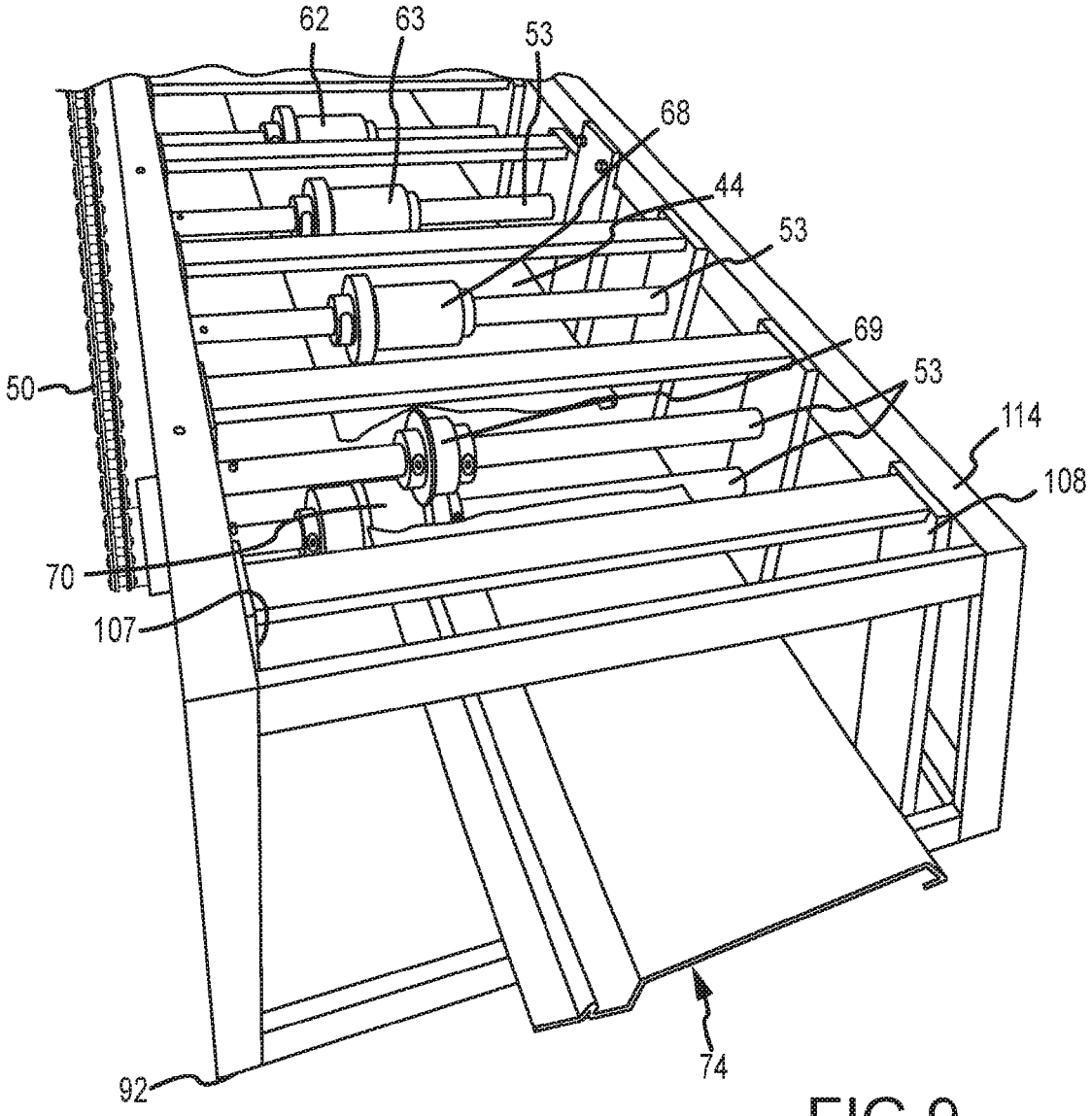
FIG. 9 is a partial perspective view of a modified end portion of the prior art seamless siding forming machine shown in FIGS. 6, 7 and 8, illustrating metal forming roller dies and a partially completed seamless siding panel emerging from the machine.
Figure 11:
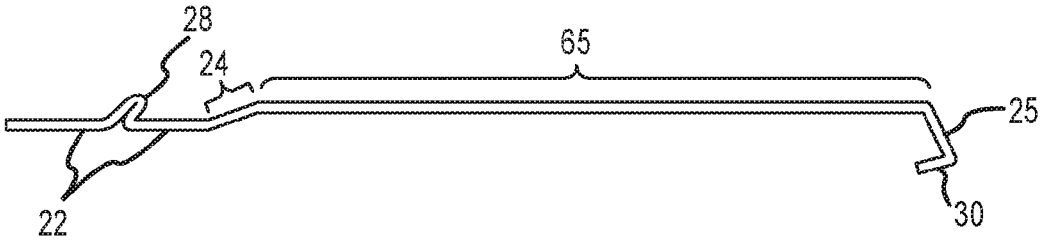
Figure 12:
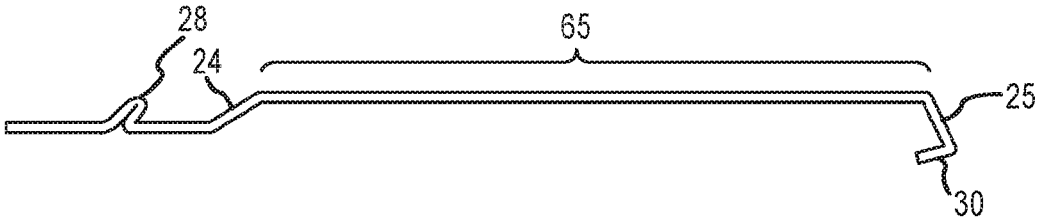

The next series of metal forming stations of the machine 36 includes conventional roller dies 62, 63 and 68 shown in FIG. 9 which produce the bends in the metal strip 44 which define the attachment edge 22, the offset wall portion 24, and an intermediate portion 65 which will become the curved portion 23 of the simulated log siding panel 20 (FIG. 2). As shown in FIG. 11, the first bends created by the die 62 (FIG. 9) extend the offset wall portion 24 a slight angle relative to the attachment edge 22 and the intermediate portion 65. As shown in FIG. 12, the next bends created by the die 63 (FIG. 9) create a greater angle of the offset wall portion 24 relative to the attachment edge 22 and the intermediate portion 65. The last bends created by the die 68 further angle the offset wall portion 24 relative to the intermediate portion 65 and relative to the attachment edge 22, as shown in FIG. 13.

Figure 13:
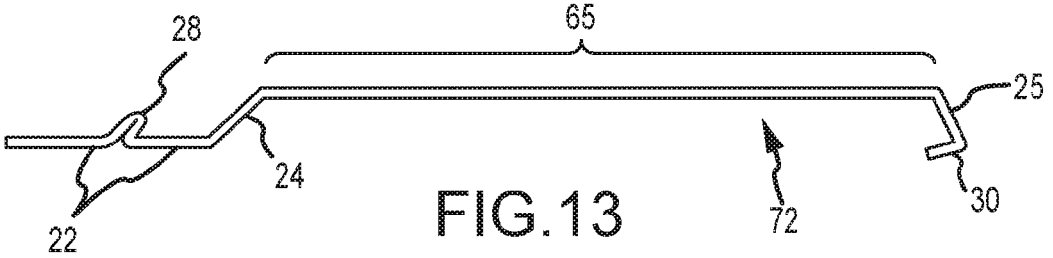

The bends in the metal strip 44 illustrated in FIG. 13 establish the final angles of the offset wall portions 24 and 25 relative to the intermediate portion 65. The final angle of the offset wall portion 24 relative to the intermediate portion 65 is approximately the same as the final angle of the offset wall portion 25 relative to the intermediate portion 65. The attachment edge 22 extends generally parallel to the intermediate portion 65.

Figure 17:
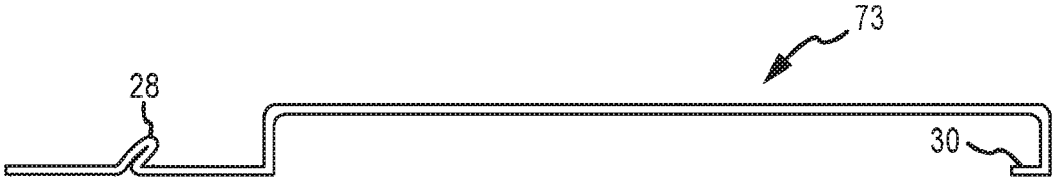
FIG.17 PRIOR ART
FIG. 17 is an end view of a prior art reverse board and batten siding panel.

The configuration shown in FIG. 13 is a partial reverse board and batten siding panel configuration 72. A conventional seamless siding forming machine which has not been modified as described herein could convert the partial reverse board and batten configuration 72 into a conventional complete reverse board and batten siding panel 73 shown in FIG. 17, by employing another metal forming station (not shown) to bend the offset wall portion 24 to extend perpendicularly from the attachment edge 22 and the intermediate portion 65 and to bend the offset wall portion 25 to extend perpendicularly to the intermediate portion 65 and to bend the lip 32 extend perpendicularly to the offset wall portion 25.

Figure 14:
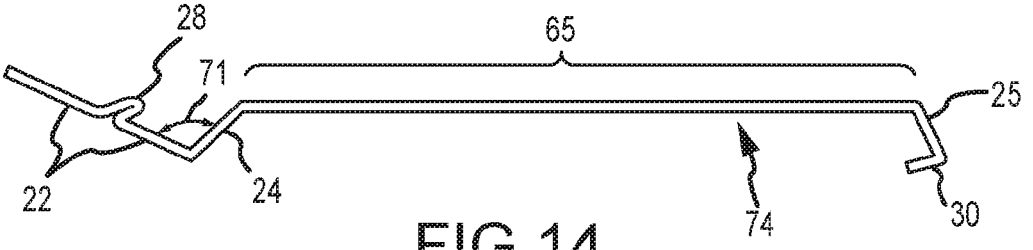
Figure 15:
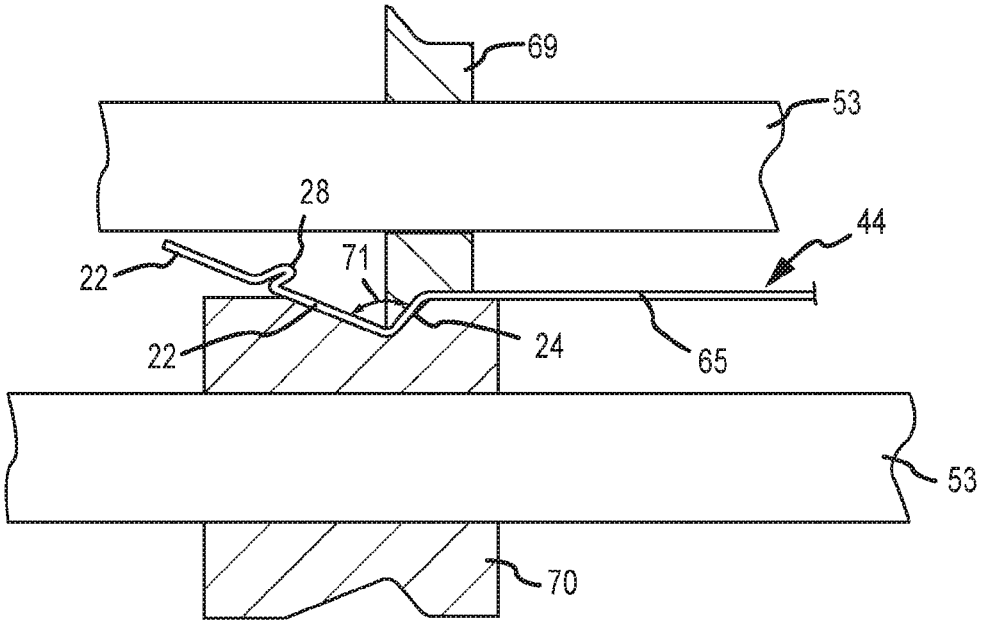
FIG. 15 is a vertical cross-sectional view of a metal forming roller die used in the siding forming machine shown in FIG. 9.

The simulated log siding panel 20 is formed from the partial reverse board and batten configuration 72 (FIG. 13) into the configuration 74 shown in FIG. 14 by two complementary metal forming roller dies 69 and 70 shown in FIGS. 9 and 15. The metal forming roller dies 69 and 70 are used as the last set of metal forming dies in the seamless siding machine 36. The dies 69 and 70 establish a final obtuse angle 71 of the attachment edge 22 relative to the offset wall portion 24, by bending the metal into the configuration 74 shown in FIG. 14. The angle 71 (FIG. 14) extends the offset wall portion 24 forward from the exterior surface 32 (FIGS. 4 and 5) when the simulated log siding panel 20 is connected to the building. The angle 71 is approximately the same as the obtuse angle 67 that the offset wall portion 25 extends from the exterior surface 32 (FIG. 4). The similar angles 67 and 71 create symmetry and uniformity in visual relief of the curved portion 23.

The configuration 74 of the panel shown in FIGS. 9 and 14 is delivered to the log forming attachment 40, where it is transformed by the log forming attachment 40 into the simulated log siding panel 20. The transformation of the panel configuration 74 into the simulated log siding panel 20 is achieved by creating the hew line-simulating bends 26 in the intermediate portion 65 (FIG. 14).

Figure 6:
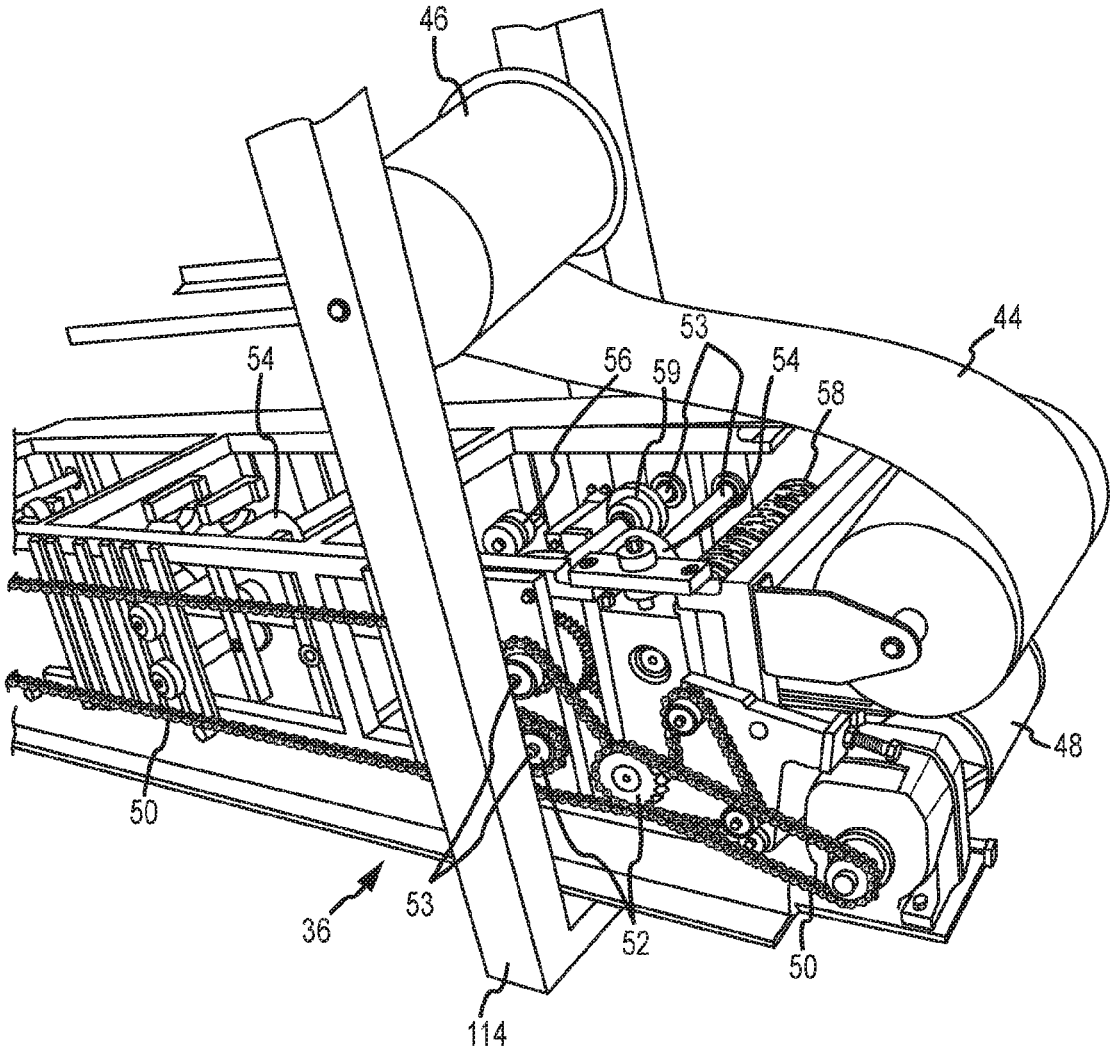
FIG.6 PRIOR ART
FIG. 6 is a generalized perspective view of a prior art seamless siding forming machine and a coil of metal used to create seamless metal siding panels.
Figure 18:
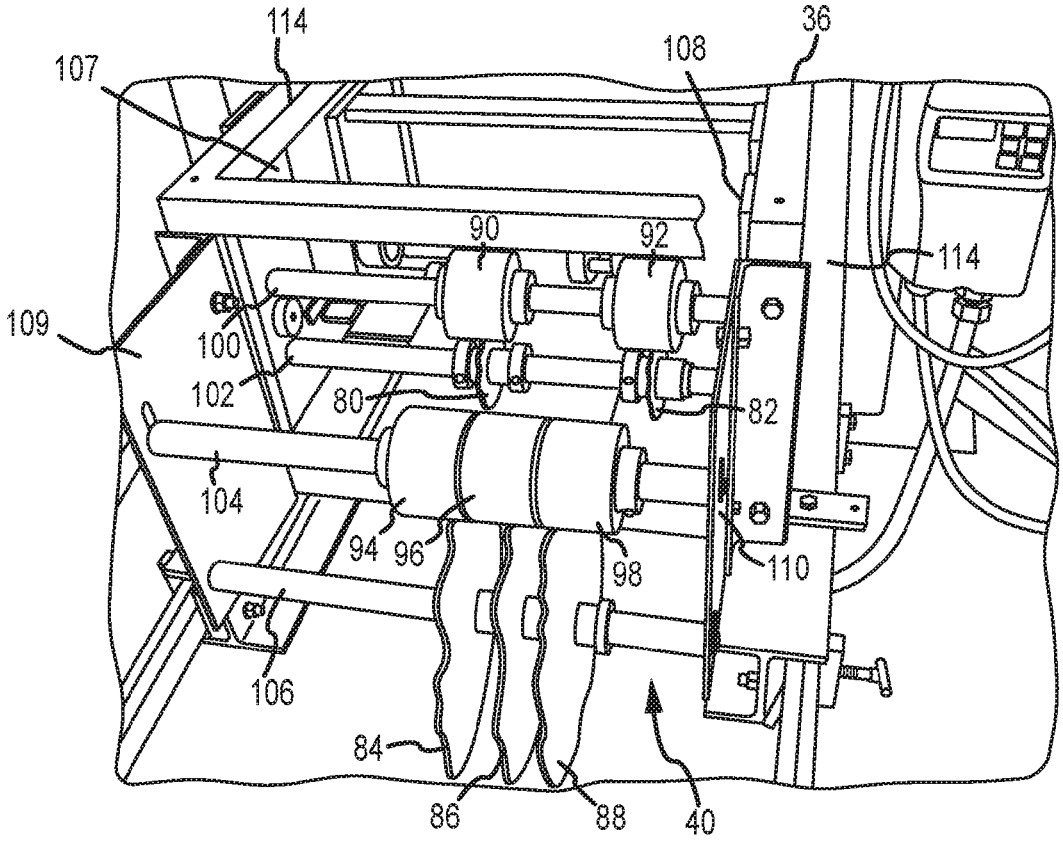
FIG. 18 is an perspective view of a log forming attachment, which incorporates the present invention, connected to the end of the prior art seamless siding forming machine shown in FIGS. 6-9, by which to transform the siding panel configuration shown in FIG. 14 into the simulated log siding panel shown in FIGS. 1-5.
Figure 19:
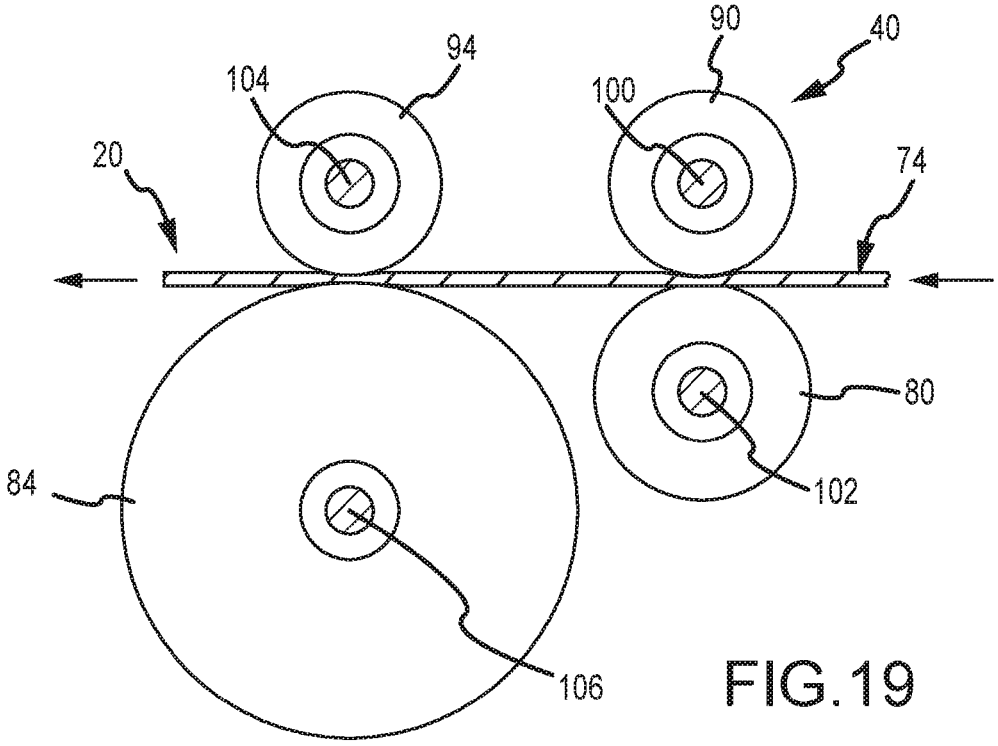
FIG. 19 is a side elevation view of associated disks and elastomeric rollers of the log forming attachment shown in FIG. 18.

The log forming attachment 40 is connected at the end of the seamless siding forming machine 36. As shown in FIGS. 18-23, the log forming attachment 40 is formed by rotatable disks 80, 82, 84, 86 and 88, which interact with associated rotatable elastomeric rollers 90, 92, 94, 96 and 98, respectively. The disks 80, 82, 84, 86 and 88 and the elastomeric rollers 90, 92, 94, 96 and 98 are not rotated by the chain 50 from the motor 48 of the seamless siding machine 36 (FIGS. 6 and 9). Instead, the disks and elastomeric rollers are rotated by the movement of the bent metal strip 44 as it is propelled from the seamless siding machine 36 and moved between the associated disks and elastomeric rollers 80 and 90, 82 and 92, 84 and 94, 86 and 96, and 88 and 98, as shown in FIG. 19.

The log forming attachment 40 includes four idler shafts 100, 102, 104 and 106. The idler shafts 100 and 102 are connected to support brackets 107 and 108 (FIG. 9) which would normally be used to support the roller dies at the end of the siding forming machine 36. The idler shafts 104 and 106 extend between attachment plates 109 and 110, which are connected on respectively opposite sides of a frame 114 of the seamless siding forming machine 36, as shown in FIGS. 9 and 18.

The two smaller diameter disks 80 and 82 are attached to and rotate around the shaft 102. The two elastomeric rollers 90 and 92 are attached to and rotate around the shaft 100. The elastomeric rollers 90 and 92 interact and rotate with the respectively associated disks 80 and 82. The position of the disks 82 and 84 on the shaft 102 aligns an outer circular periphery of those disks with an outer cylindrical surface of the elastomeric rollers 90 and 92 retained on the shaft 100. The three larger diameter disks 84, 86 and 88 are attached to and rotate around the shaft 106. The three elastomeric rollers 94, 96 and 98 are attached to and rotate around the shaft 104. The elastomeric rollers 94, 96 and 98 interact and rotate with the respectively associated disks 84, 86 and 88. The position of the disks 84, 86 and 88 on the shaft 106 aligns an outer circular periphery of those disks with an outer cylindrical surface of the elastomeric rollers 94, 96 and 98 retained on the shaft 104.

The space between the shafts 100 and 102 is adjustable, and that space determines the spacing between the associated disks and elastomeric rollers 80 and 90, and 82 and 92. Similarly, the space between the shafts 104 and 106 is also adjustable, and that space determines the spacing between the associated disks and elastomeric rollers 84 and 94, 86 and 96, and 88 and 98. T his spacing determines the extent of deformation of the intermediate portion 65 (FIGS. 14, 22 and 23) when the hew line-simulating bends 26 are created.

Figure 20:
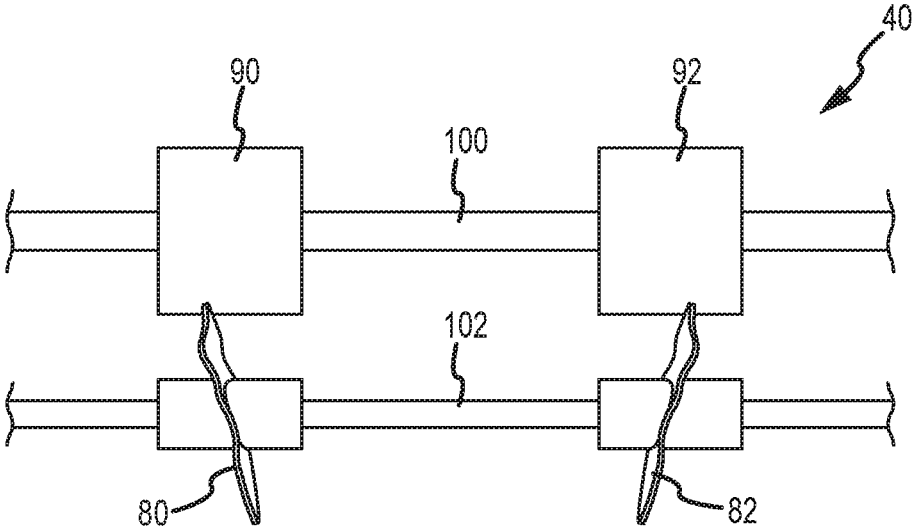
FIG. 20 is an end elevation view of some of the associated disks and elastomeric rollers of the log forming attachment shown in FIGS. 18 and 19.
Figure 21:
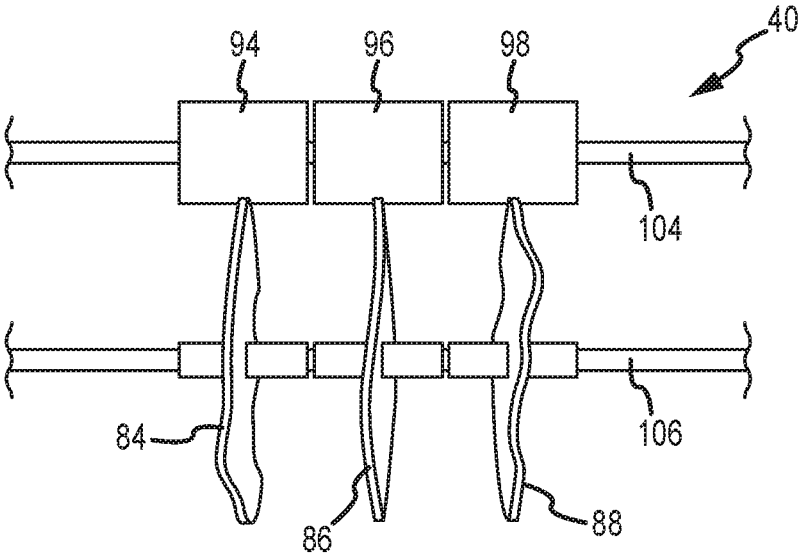
FIG. 21 is an end elevation view of the other ones of the associated disks and elastomeric rollers of the log forming attachment shown in FIGS. 18 and 19.

The periphery of the disks 80, 82, 84, 86 and 86 have each been deformed transversely relative to a plane that would otherwise be occupied by those disks if their outer peripheral edges were not deformed, as shown in FIGS. 18 and 20-23. The extent and pattern of tranverse deformation of the outer periphery of each of the disks is random and different from that of the other disks. As a result of this deformation, the exterior periphery of the disks 80, 82, 84, 86 and 88 does not track in a path which is orthogonal to the axis of the shafts 102 and 106 or parallel to the direction of movement of the bent metal strip 44 through the machine 36, as the disks rotate. Instead, the path followed by the outer periphery of the disks moves from side to side as the disks rotate, at the location where the disk peripheries adjoin the elastomeric rollers. Furthermore, as is shown in FIG. 20, each complete disk 80 and 82 may be oriented in a non-orthogonal relationship to the axis of the shaft 102. This non-orthogonal relationship further accentuates the transverse side to side movement of the periphery of the disks 80 and 82. The deformed outer periphery of the disks and the non-orthogonal positioning of the disks on the shafts causes the exterior periphery of the disks to move laterally, side-to-side in different and random paths, none of which are parallel to the movement of the bent metal strip 44.

Figure 22:
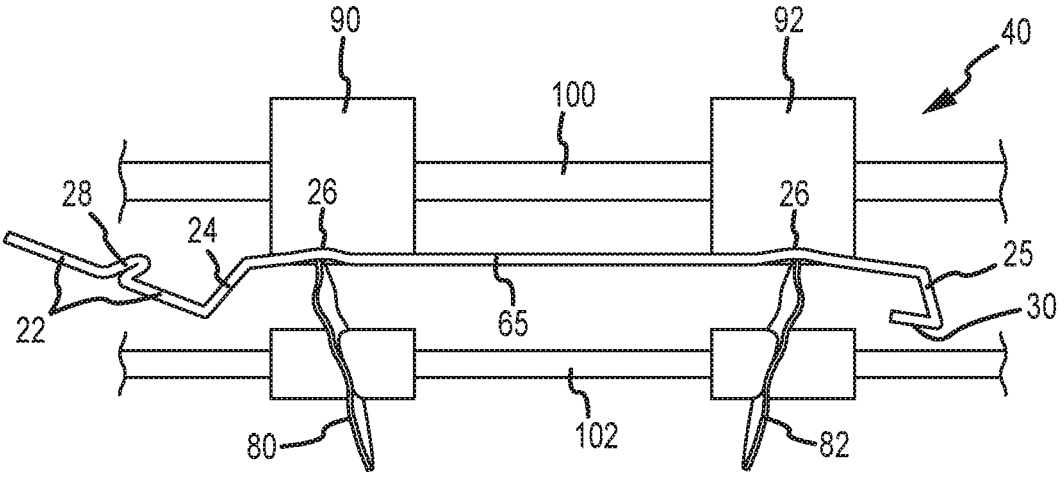
FIG. 22 is an end elevation view of a portion of the log forming attachment shown in FIG. 20, showing initial transformation of the configuration shown in FIG. 14 into the simulated log siding panel shown in FIGS. 1-5.
Figure 23:
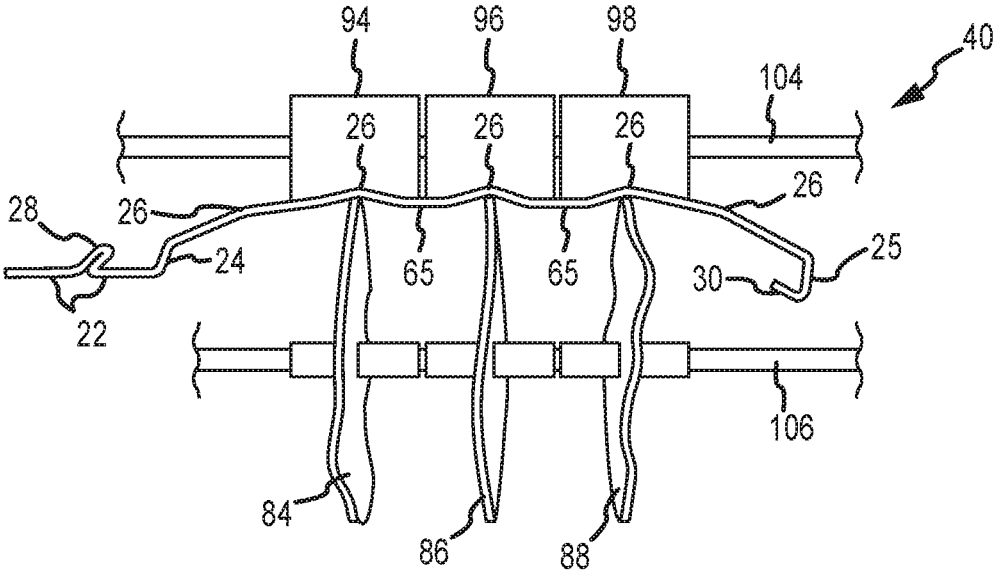
FIG. 23 is an end elevation view of a portion of the log forming attachment shown in FIG. 21, showing final transformation of the configuration shown in FIGS. 14 and 22 into the simulated log siding panel shown in FIGS. 1-5.

When the bent metal configuration 74 moves between the disks 80, 82, 84, 86 and 88 and the elastomeric rollers 90, 92, 94, 96 and 98, as shown in FIG. 19, the circular exterior peripheral edge of the disks slightly compresses the intermediate portion 65 of the configuration 74 (FIGS. 9, 14, 22 and 23) into the elastomeric rollers and forms the hew line-simulating bends 26, as shown in FIGS. 22 and 23. The compression of the elastomeric rollers 90, 92, 94, 96 and 98 by the peripheries of the disks 80, 82, 84, 86 and 88 force the intermediate portion 65 into the elastomeric rollers and creates the hew line-simulating bends 26. The amount of compression and bending of the intermediate portion 65 shown in FIGS. 22 and 23 is more than the amount of actual permanent deformation exhibited by the hew line-simulating bends 26 (FIG. 2), because the metal tends to spring back slightly after it has been bent by the disks and elastomeric rollers.

The hew line-simulating bends 26 created by the disks and elastomeric rollers also have the effect of transforming the flat intermediate portion 65 (FIG. 14) into the curved portion 23 of the simulated log siding panel 20 (FIG. 2). The hew line-simulating bends 26 create curvature in the curved portion 23. The curvature of the portion 23 is irregular along its length because of the random transverse spacing and position of the bends 26, thereby better simulating the uneven exterior appearance of a natural construction log.

Because of the amount and random characteristic of the lateral distortion of the outer peripheral edges of each of the disks 80, 82, 84, 86 and 88 is different, and because the disks may be connected in a non-orthogonal orientation for rotation on the shafts 80 and 84, the rotation of the disks against the elastomeric rollers causes the hew line-simulating bends 26 to move transversely relative to one another and relative to the margins of the intermediate portion 65 along the length of the panel. Further nonuniformity results because of the difference in relative diameters of the disks 80 and 82, compared to disks 84, 86 and 88. Because the smaller diameter disks 80 and 82 rotate more rapidly compared to the rotation of the larger diameter disks 84, 86 and 88, the pattern of hew line-simulating bends 26 induced by the more rapidly rotating smaller diameter disks 80 and 82 repeats more frequently than the repetition of the pattern created by the slower rotating larger diameter disks 84, 86 and 88. Therefore, the entire pattern of hew line-simulating bends 26 exhibits substantial nonuniformity, non-repetitiveness and randomness in transverse position, relative to one another and to the margins of the curved portion 23 of the simulated log panel 20, as well as randomness, nonuniformity and non-repetition of the hew line patterns created, resulting in an appearance which more realistically and authentically simulates the appearance of a natural construction log.

The elastomeric rollers 90, 92, 94, 96 and 98 exhibit hardness of approximately fifty (50) durometers. Elastomeric rollers having this hardness have proved satisfactory in making well-defined hew line-simulating bends 26 in simulated log siding panels 20 formed from 26 to 30 gauge steel or 0.027 to 0.032 inch thick aluminum. Thicker or thinner metal may require the use of elastomeric rollers having a greater or lesser durometer hardness. Of course, because the disks and associated elastomeric rollers have continuous rolling contact with the metal strip as it advances through the siding forming machine 36, the hew line-simulating bends 26 extend continuously along the length of the simulated log siding panel 20.

The capability to create the hew line-simulating bends 26 offers substantial improvements in the realism and appearance of simulated log siding panels. The random nature of the hew line-simulating bends 26 contributes to the realism by replicating the random nature of hew lines in natural construction logs. The hew line-simulating bends 26 also change the curvature of the curved portion 23 in a somewhat irregular or uneven manner, thereby simulating the uneven nature of natural construction logs and simultaneously avoiding the unrealistic appearance of the repeating pattern of cylindrical prior art simulated log panels.

The log forming attachment 40 is used in conjunction with a conventional seamless siding forming machine 36 to transform partial conventional siding patterns, such the partial reverse board and batten configuration 72 (FIG. 13) or the partial shiplap configuration (FIG. 10), into the simulated log siding panel 20. The same conventional seamless siding machine can be used to create other patterns and configurations of seamless siding, by removal of the log forming attachment 40 and other modifications described above and installing the conventional metal forming parts that were removed. Such changes are easily accomplished and doing so avoids the need for a separate seamless siding forming machine dedicated only to forming simulated log simulated log siding panels.

Many other improvements and advantages will become apparent upon gaining a complete appreciation of the scope, significance and ramifications of the present invention. Preferred embodiments of the invention and many of its improvements have been described with a degree of particularity. The detail of the description is of preferred examples of implementing the invention. The detail of the description is not necessarily intended to limit the scope of the invention. The scope of the invention is defined by the following claims.

The invention claimed is:

1. An elongated metal simulated log siding panel, comprising:

an intermediate portion of the panel that extends longitudinally along the length of the panel and simulates a natural construction log having hew lines; and a plurality of longitudinally extending and transversely spaced permanent bends in the intermediate portion which simulate the hew lines of the natural construction log; wherein:

the transverse position of the hew line-simulating bends varies relative to margins of the intermediate portion along the length of the panel; and the transverse position of the hew line-simulating bends varies relative to one another along the length of the intermediate portion of the panel; and further comprising:

offset wall portions extending rearwardly from opposite margins of the intermediate portion to project the intermediate portion forward and give relief to the intermediate portion.

2. An elongated metal simulated log siding panel as defined in claim 1, wherein:

the hew line-simulating bends extend substantially continuously along the length of the intermediate portion of the panel.

3. An elongated metal simulated log siding panel as defined in claim 1, wherein:

the intermediate portion of the panel is curved transversely forward relative to the length of the intermediate portion.

4. An elongated metal simulated log siding panel as defined in claim 3, wherein:

the transverse forward curvature of the intermediate portion is created by the hew line-simulating bends.

5. An elongated metal simulated log siding panel as defined in claim 1, further comprising:

an edge portion extending outward from one offset wall portion a sufficient distance to establish an area upon which simulated chinking can be added.

6. An elongated metal simulated log siding panel as defined in claim 1, wherein:

the panel is constituted from a strip of metal.

7. An elongated metal simulated log siding panel as defined in claim 1, wherein:

the panel is constituted from a continuous strip of metal.

* * * * *